US005471942A

United States Patent [19]

Miller et al.

[11] Patent Number: 5,471,942

[45] Date of Patent: Dec. 5, 1995

[54] HYDROFOIL SAILBOARD WITH SUPERCAVITATING CANARD HYDROFOIL

[76] Inventors: Richard T. Miller, 1521 Posen Ave., Albany, Calif. 94706; Marlo R. Martin, 1815 Delaware St., Berkeley, Calif. 94703

[21] Appl. No.: 342,380

[22] Filed: Nov. 18, 1994

Related U.S. Application Data

[63] Continuation-in-part of Ser. No. 201,803, Feb. 25, 1994, abandoned.

[51] Int. Cl.[6] ..... B63B 1/24

[52] U.S. Cl. ..... 114/274; 114/39.2

[58] Field of Search ..... 114/39.2, 274, 114/275–282; 441/74

[56] References Cited

U.S. PATENT DOCUMENTS

| | | | |
|---|---|---|---|
| 2,890,672 | 6/1959 | Boericke, Jr. | 114/66.5 |
| 3,114,343 | 12/1963 | Headrick et al. | 114/66.5 |
| 3,121,890 | 2/1964 | Rumsey, Jr. | 9/310 |
| 3,369,513 | 2/1968 | Nott | 114/281 |
| 3,459,146 | 8/1969 | Prior | 114/66.5 |
| 3,464,377 | 9/1969 | Von Schertel | 114/66.5 |
| 3,804,047 | 4/1974 | Faber et al. | 114/66.5 H |
| 4,432,298 | 2/1984 | Cudmore | 114/39 |
| 4,508,046 | 4/1985 | Coulter et al. | 114/39 |
| 4,715,304 | 12/1987 | Steinberg | 114/39.2 |
| 5,062,378 | 11/1991 | Bateman | 114/274 |
| 5,309,859 | 5/1994 | Miller | 114/274 |

FOREIGN PATENT DOCUMENTS

| | | | |
|---|---|---|---|
| 3130554 | 3/1983 | Germany | B63B 35/72 |

OTHER PUBLICATIONS

Lewis, B., The Harken Hydrofoil, Harken Vanguard News, Summer 1985, pp. 17–19.

Dobay, G. F. Hydrofoils Designed for Surface Ventilation, Proceedings of the Hydrofoil Symposium, Soc. of Naval Architects and Marine Engineers, Spring 1965, pp. f1–f12.

Marshall "Advanced hydrofoil design . . . ", Product Engineering vol. 41, No. 221, 28 Sep. 1970, pp. 20–21.

Fock, "Schiffs technik: Die allgemeinen Eigenschaften des Tragflächenbootes", Soldast und Technick, No. 3 Mar. 1971, pp. 144–149.

*Primary Examiner*—Jesus D. Sotelo

[57] ABSTRACT

Canard configured hydrofoil sailboards which are normally operated rolled to windward and without yaw and which employ a canard hydrofoil that tracks the water surface are of proven practicality. The present hydrofoil sailboard improves on previous designs by replacing the conventional canard hydrofoil by one of supercavitating type (30), operated in freely ventilating mode. This leads to markedly better surface tracking. This hydrofoil sailboard further improves on previous designs by employing a canard hydrofoil hinged (50,60) so that it can be rolled to one side or the other and locked into the rolled position. The use of a locked, hinged canard hydrofoil leads to a new hydrodynamic force distribution having significant benefits. Among these are improved sail balance which allows conventional sailboard sail and harness arrangements to be used. Additionally, steering by means of board rolling is much improved. The use of the freely ventilating supercavitating canard hydrofoil makes feasible ramifications of the hydrofoil sailboard in which the hinged canard hydrofoil is replace by a fixed hydrofoil having one of a number of specific shapes (80–82). With appropriate choice of shape, these ramifications maintain, to varying degrees, the benefits of the hydrofoil sailboard with the hinged canard while enjoying greater simplicity of construction and operation.

17 Claims, 15 Drawing Sheets

HYDROFOIL SAILBOARD WITH SUPERCAVITATING CANARD HYDROFOIL

CROSS-REFERENCE TO RELATED APPLICATION

This is a continuation-in-part of Ser. No. 08/201,803, filed Feb. 25,1994, now abandoned.

BACKGROUND—FIELD OF INVENTION

This invention relates to small sail-powered watercraft known as sailboards, and specifically, to sailboards equipped with wing-shaped structures known as hydrofoils which depend from the sailboard hull and which operate in contact with the water so as to lift the sailboard hull out of the water when the craft is sailed.

BACKGROUND—PRIOR ART—SURFACE TRACKING BY A CANARD HYDROFOIL

U.S. Pat. No. 5,309,859 (1994) to Miller, one of the present inventors, discloses a hydrofoil sailboard comprising a forwardly mounted hydrofoil and a larger rearwardly mounted hydrofoil. This arrangement of hydrofoils is generally known as a canard configuration. The hydrofoil in front is called the canard hydrofoil, while the one behind is called the main hydrofoil. The device is designed so that during foilborne operation, the canard hydrofoil travels at or near the water surface, and the main hydrofoil remains submerged. The success of such a design depends critically on the ability of the canard hydrofoil to effectively ride along the water surface despite wave action and load variation. A hydrofoil operating in this way is said to be surface tracking.

Conventional hydrofoils are not very good at surface tracking, being susceptible to a disruption of operation known as plunging. Plunging is defined as the physical phenomenon where a previously submerged foil comes to the water surface, then immediately resubmerges with an air bubble attached to its top surface. The bubble eventually dissipates, by losing air into the surrounding water flow, but this dissipation may take some time, and until it is complete, the lift of the foil is much reduced from its value when no bubble is attached. Plunging is especially harmful to surface tracking since it tends to occur erratically both in time and in the amount of lift lost. The disclosure cited above shows several canard designs that help to speed shedding of attached air bubbles, and thus ameliorate plunging. All of these are based on conventional streamlined hydrofoils with teardrop shaped profiles of the type known as subcavitating. Subcavitating hydrofoils are designed to get a major portion of their lift from suction on their upper surfaces; that suction largely disappears when an air bubble is attached.

Although the canard hydrofoils disclosed are able to avoid plunging better than those previously available, they are not completely immune, and consequently the watercraft is liable to pitch nose downward uncontrollably and without warning.

The only prior-art hydrofoil sailboard besides the one cited above that incorporates hydrofoils meant to track the water surface is disclosed in German patent 3,130,554 A1 (1983) to Jankowski. The hydrofoils shown are apparently conventional teardrop shaped ones that obtain lift from both their top and bottom surfaces. Jankowski says only that his foils are to have "hydrodynamic profile". Elsewhere he states that one of the distinctions between hydrofoils and planing (surfboard) hulls is that the latter obtain their lift only from the bottom surface.

U.S. Pat. No. 3,121,890 to Rumsey, Jr. (1964) shows a water ski with a pair of hydrofoils mounted beneath, one hydrofoil in front of the other, arranged so that the forward one rides higher than the rear one. He does not indicate if his purpose in this arrangement is to enable the front hydrofoil to rise to the water surface and stay there.

PRIOR ART—SUPERCAVITATING HYDROFOILS

There is another class of hydrofoils, called supercavitating, that have properties particularly suited to very high-speed applications. Supercavitating hydrofoils are well known, but because they are extremely inefficient compared to conventional hydrofoils, and since only a very few test craft have been constructed that go to speeds where supercavitating hydrofoils provide advantage over conventional ones, they have not come into common use. U.S. Pat. No. 2,890,672 to Boericke, Jr. (1959) shows a ladder hydrofoil structure comprising three classes of hydrofoils, one class being supercavitating. An extensive discussion of supercavitating hydrofoils is available in the report entitled "Hydrofoils Designed for Surface Ventilation—An Experimental Analysis" given in the Hydrofoil Symposium held at the 1965 Spring Meeting, Seattle Washington, of the Society of Naval Architects and Marine Engineers by Gabor F. Dobay.

Conventional hydrofoils become subject to erratic behavior when pushed to high speeds. For these foils, there is a speed, which depends on details of the foil design and operation, at which pressure reduction on the upper surface becomes so great that the water there spontaneously vaporizes, forming a cavity, whose effect is a decided and unsteady loss of lift. Supercavitating hydrofoils are designed specifically to induce, and then stabilize, a gaseous cavity, filled with water vapor, or sometimes, air, covering much or all of the upper surface of the foil. Because the cavity is stabilized, erratic behavior is eliminated. Supercavitating hydrofoils get most of their lift from hydrodynamic pressure on their bottom surface; their top surface is typically subject to more-or-less uniform static pressure determined by the physical state of the gas. Supercavitating hydrofoils are usually designed with a sharp leading edge and an abruptly truncated trailing edge. The angle of inclination between a foil and the surrounding water flow is call the angle of attack. At a sufficiently large attack angle, a region of very low pressure is formed at the sharp leading edge which causes a cavity to be formed and maintained just behind that edge.

Sometimes supercavitating hydrofoils are used in what is known as freely ventilating mode, where the upper foil surface is connected to the water surface by a ventilation path which allows atmospheric air to be drawn into the cavity. Beyond such free ventilation, forced ventilation, in which pressurized ,air is forced into the cavity has been tried.

Supercavitating hydrofoils are inherently much less efficient than conventional subcavitating ones. This is partly because of the virtual absence of upper surface lift, and partly because of the high drag due to the unsteady and very unstreamlined downstream end of the cavity. In practice, even the modest theoretical efficiency of supercavitating hydrofoils is not realized. Thus, the use of supercavitating hydrofoils is taught when it is unavoidable; that is, when a conventional foil would cavitate anyway.

If the use of supercavitating hydrofoils in vapor cavity mode has little to recommend it, their use with free ventilation is seen to be still less inviting. Dobay, above, gives experimental evidence for a sudden, erratic mode change instability that occurs for freely ventilating supercavitating hydrofoils between a near surface planing mode and a fully ventilated cavity mode at the same depth, which mode change is accompanied by a large change in foil lift coefficient. Because of this instability, Dobay concludes that, especially at small foil operating depths, the feasibility, of a hydrofoil boat supported by such (freely ventilating) supercavitating hydrofoils is very doubtful. Indeed, he cites the famous capsize of the Boeing Company's supercavitating test vehicle FRESH-I, which, he says, was due to a transition to planing on just one side of her forward hydrofoil.

Boericke, Jr. (Boericke) teaches using supercavitating hydrofoils that are well submerged, as witnessed by the high speed waterline indicated in his figures. He notes that atmospheric air can be entrained by hydrofoils and cause loss of lift and teaches the use of extra hydrofoils, normally riding clear of the water, to provide reserve lift in that eventuality. He is silent on the matter of failure of this reserve due to plunging, on fences to prevent ventilation along the ladder supports, and on the notion of purposely allowing a supercavitating hydrofoil to ventilate.

In view of this, it was not to be expected that a freely ventilating hydrofoil of the supercavitating type might be used at low and medium speeds for accurate and reliable surface tracking.

BACKGROUND—HYDROFOIL SAILBOARDS

The disclosure of Miller, above, does not mention supercavitating hydrofoils. Indeed, it is concerned with rapid bubble shedding for mitigation of plunging. Freely ventilating supercavitating hydrofoils operate in the presence of a permanent bubble. The canard support disclosed comprises a swiveling streamliner and a seal, as well as other means, to prevent airflow from the atmosphere to the canard hydrofoil. With the use of a freely ventilating supercavitating canard, ventilation is to be encouraged rather than prevented.

U.S. Pat. No. 4,508,046 to Coulter et al. (1985) discloses a hydrofoil sailboard which includes a pair of identical self-righting, surface-piercing hydrofoils arranged in tandem. Such hydrofoils automatically adjust their depth of operation to variations in speed; the more speed, the higher these hydrofoils ride. Thus the hydrofoil assemblies shown in Coulter et al. (Coulter) are inherently incapable of tracking the water surface in the sense that they remain on the surface or at a fixed shallow depth during operation.

The hydrofoil profiles shown in Coulter might conceivably be able to stabilize a vapor cavity on their upper surface, but not when used as described. Certainly the hydrofoils shown are not freely ventilating. The hydrofoils illustrated have sharp leading edges and sharp trailing edges. This is an unusual design; a hybrid of sorts between the usual subcavitating and supercavitating hydrofoils. Coulter is silent on the reasons for choosing such a design. Perhaps it is an extension of the well known idea of sharpening the leading edge of a rudder where it passes through the water surface in order to reduce wave making at that point. Since surface-piercing hydrofoils have the inherent property of operating at different depths at different speeds, there is no single place where the hydrofoil enters the water. One response to this indeterminacy would be to sharpen the leading edge everywhere.

Because of the sharp leading edge, at sufficient angle of attack, these hydrofoils would be expected to cavitate. However, Coulter calls for an attack angle of between 2 and 5 degrees measured against the fiat lower surface of these hydrofoils. Even the higher angle would not be sufficient to cause the hydrofoils illustrated to cavitate at the leading edge.

Elsewhere Coulter mentions alternative conventional NACA foil profiles. Since fences are provided to prohibit surface air from reaching the hydrofoils, if the illustrated hydrofoils were to cavitate, the cavity would have to be water vapor filled, not freely ventilating.

U.S. Pat. No. 4,715,304 to Steinberg (1987) shows a hydrofoil sailboard that incorporates conventional subcavitating hydrofoils.

An unpatented hydrofoil assembly meant for attachment to a Windsurfer brand sailboard was marketed by the Harken company and described by Brownie Lewis in the article "The Harken Hydrofoil or Freaking Out the fishermen!", Harken Vanguard News, Summer 1985. It, too, incorporates subcavitating hydrofoils.

Neither the device of Steinberg nor that of the Harken company incorporates any automatic means of maintaining the height of the craft during operation. This places the burden of height control on the sailor, who has to constantly move his or her weight to alter the craft's attitude, and thus, indirectly, its height. This proves to be an almost impossible task. As indicated in the Lewis article, it is very hard to keep the craft from porpoising, which is an uncontrolled, periodic, up-and-down motion, frequently so severe that the hydrofoils completely leave the water. Because the foils used in these devices are of subcavitating type, they are susceptible to plunging, which means that when they return to the water after being airborne, they are not likely to provide sufficient lift to stop 1he descent before the craft's hull hits the water.

PRIOR ART—SAIL BALANCE

The sailing art teaches that lateral forces generated by the sails are balanced by hydrodynamic forces generated by the hull and appropriate auxiliary foils (daggerboard, rudder, skeg, etc.) moving in yaw, that is to say, turned somewhat to the side, slightly crablike, relative to the water flow. The modern sailing art teaches that, to the greatest extent possible, lateral forces should be resisted by those from the auxiliary foils rather than from the hull. In the case of hydrofoil sailing craft, the hull lifts clear of the water and is removed from the equation, and the forces produced by it are replaced by those from hydrofoils that do the lifting. The vast majority of hydrofoil sailing craft are sailed flat and in yaw. Indeed, for broad beamed craft like hydrofoil catamarans, or ice-boat type vessels, this is the only possibility. Narrow craft, like hydrofoil sailboards have another option, discussed at length in Miller, above: If appropriately designed, they can be sailed leaning to the side from which the wind blows, and can use the lateral force generated by the hydrofoils to resist the lateral aerodynamic force. When sailed in this way, denoted as rolled to windward, the need to sail in yaw can be eliminated, resulting in a considerable gain in efficiency.

However, the operating principle of sailing in windward roll without yaw combined with the design shown has one considerable drawback which is spelled out in detail in the disclosure: namely, it implies coincidence of the centers of lateral and vertical force generated by the hydrofoils. This results in the loss of a degree of freedom that is usually available for sail balance. This loss is serious since it precludes the use of a conventional sailboard sail and rig.

No alternative hydrofoil configuration is shown that together with the operating principle of sailing in windward roll without yaw would lead to a separation of the centers of lateral and vertical hydrodynamic force. Instead the disclosure teaches a new and, as it turns out, awkward, change in rig and sail as the way around the coincidence problem.

In the hydrofoil sailboard art, besides this device, only the disclosure of Jankowski, above, suggests operating in windward roll. But, as Jankowski provides a daggerboard, it is clear that his sailboard must be operated in yaw. Jankowski says that in order to go to the highest speeds, his craft may be slightly rolled—just enough to allow all but the windward tips of the surface tracking hydrofoils to ride clear of the water. This amount of roll cannot provide enough side force by itself to balance the lateral aerodynamic force.

The rest of the hydrofoil sailboard art, except for Steinberg, shows auxiliary daggerboards and/or skegs, and so like Jankowski, teaches sailing in yaw. The design of Coulter with its tandem self-righting hydrofoils would, if sailed in windward roll, generate leeward directed lateral force from those hydrofoils, which would only serve to increase the load on the daggerboard and skeg, and so cause major performance degradation with no compensating benefit.

Steinberg, above, is silent on questions of roll, yaw, and lateral force balance.

PRIOR ART—CANARD HYDROFOIL HINGED IN ROLL

U.S. Pat. No. 3,804,047 to Faber et al. (1974) shows a retraction arrangement for the bow foil of a hydrofoil craft. This arrangement includes a hinge in the keel plane of the craft, but the hinge is taught as a way of shifting the hydrofoil from its usual submerged operating position symmetric with the craft's keel plane into a storage position where again the hydrofoil support is symmetric with that plane, and where the hydrofoil is totally clear of the water. The hinge does not enable the bow hydrofoil to be shifted among different non-storage positions.

PRIOR ART—CANARD HYDROFOIL HAVING DIHEDRAL

A hydrofoil having its lateral halves joined at an angle so that its forward projection is V-shaped is said to have dihedral. Although there are numerous references in the prior art that show hydrofoil watercraft with canard hydrofoil having dihedral, there is no suggestion how such hydrofoils might be adapted for surface tracking use on a hydrofoil sailboard sailed rolled to windward.

Many prior-art designs show a forward hydrofoil of self-righting, surface-piercing type. These designs can be seen as having canard dihedral, but they are not appropriate for use in a hydrofoil sailboard meant to be normally operated in windward roll, since the hydrodynamic force distribution that makes these hydrofoils self-righting always includes a force component pointing away from the direction of roll. That force component degrades steering by increasing the tendency for additional roll to windward to cause the craft to steer to leeward. This steering behavior is opposite to that desirable for a hydrofoil sailboard.

A example of a design like this is disclosed in U.S. Pat. No. 3,464,377 to von Schertel (1969) which shows an engine driven hybrid hydrofoil watercraft with self-righting surface-piercing forward hydrofoil and fully submerged rear hydrofoil. When rolled, the rear hydrofoil generates a lift component toward the side of the roll while the forward surface-piercing hydrofoils generate a restoring force that has a lateral component directed away from the roll. This lateral force couple converts roll into opposite yaw, which is a hindrance rather than a help even in the context of its own design.

One embodiment of the device of Rumsey, Jr., above, (Rumsey) shows a V-shaped forward hydrofoil and a similarly shaped, but larger rear hydrofoil. During operation, the forward hydrofoil might ride higher than the rear one. However, Rumsey does not state that it should come to the surface. Rumsey's device is presumably meant to be able to operate in some degree of roll, since water skis are typically rolled away from the pull of the tow rope. However, Rumsey does not discuss the effect of roll on the operation of his device. Nor does he discuss the question of the relative centers of lateral and vertical force generated by the hydrofoils or the relationships of those centers to the force from the tow rope. In fact, he relationships among these forces necessary for operation of hydrofoil water skis is not the same as that needed for a hydrofoil sailboard using a conventional sail and harness arrangement, so that, to the extent Rumsey's hydrofoils satisfy the objectives of his device, they fall to be appropriate for a hydrofoil sailboard.

PRIOR ART—CANARD HYDROFOIL HAVING AN ARC-SHAPED FRONTAL PROJECTION

Watercraft having hydrofoils with arc-shaped frontal projections are known. U.S. Pat. No. 4,432,298 to Cudmore (1984) discloses a sailing craft supported by a tandem pair of identical surface-piercing hydrofoils having an inverted arch configuration (approximately arc-shaped frontal projection). Aside from the hydrofoil frontal projection, Cudmore's device is quite similar to that of Coulter, differing principally in the provision of fence-like skegs on the hydrofoils to provide lateral force, and in the rig. Since the hydrofoils are self-righting, Cudmore's watercraft, like that of Coulter cannot be usefully sailed in roll.

U.S. Pat. No. 5,062,378 to Bateman (1991) discloses a surfboard equipped with hydrofoils, and in one embodiment which comprises a single hydrofoil and a number of skegs, teaches that the hydrofoil may have an arc-shaped frontal projection. Bateman specifies that this arc—shaped hydrofoil be attached to the surfboard at its tips, thereby severely limiting the degree of roll available and also precluding the use of tip effects to control the foil's resultant lift vector. He further specifies that the hydrofoil be constructed so that the tip profiles show a greater angle of attack than those near the keel plane, which has the effect of making the hydrofoil self-righting. Since, in the embodiment having an arc-shaped frontal projection, Bateman discloses just a single hydrofoil, there is, of course, no interaction between hydrofoils to affect lateral force balance.

PRIOR ART—SUPERCAVITATION AND SURFACE TRACKING COMBINED

Dobay, above, shows a supercavitating hydrofoil attached to a supporting strut that allows the hydrofoil to be self-ventilating. He describes the hydrodynamic properties of such a hydrofoil assembly, including the case where the hydrofoil rides at the water surface. However, Dobay does not disclose any combination of hydrofoils, nor does he suggest any particular use of his hydrofoil assembly on a watercraft. Indeed, Dobay discloses a specific hydrodynamic instability to which such assemblies are subject, and voices pessimism that the ill consequences of that instability can be overcome in practical watercraft.

Boericke, above, shows a single hydrofoil assembly comprising a ladder of hydrofoils in which the lowest member is supercavitating. Boericke does not disclose any combination of his hydrofoil assemblies on a watercraft. Moreover, the figures indicate a "top speed waterline" considerably above the illustrated position of the supercavitating hydrofoil, and thus teach away from the use of such a hydrofoil at the water surface.

Rumsey, above, shows hydrofoil profiles generally like those of Coulter, having a sharp leading edge. Rumsey does not state that these profiles are to be used in a supercavitating mode.

PRIOR ART—CONCLUSION

Thus all hydrofoil arrangements heretofore known suffer from one or more of the following disadvantages when used on a hydrofoil sailboard:

(a) They have conventional subcavitating hydrofoils which cannot track the water surface reliably.

(b) They have supercavitating type foil profiles that are shown operating fully submerged, or which are not shown in combination with other foil elements in a feasible arrangement for an operating watercraft.

(c) They include foil elements that may function in a supercavitating mode but which are shown operating in a manner that would preclude supercavitation, or they include other elements such as anti-ventilation fences that would preclude operation in a freely ventilating mode.

(d) They have self-righting hydrofoil elements, and so resist rolling. If they have auxiliary foils meant to operate in yaw, then their use rolled to windward reduces efficiency. If they have only self-righting hydrofoil elements, and no foils operating in yaw, then they cannot be sailed rolled to windward at all, but must be sailed rolled to leeward. If they have a self-righting foil element in front and a rear foil element that is non-self-righting or not as effectively self-righting as the front foil element, then rolling to windward tends to steer to leeward, which is inappropriate.

(e) When rolled, they have coincident centers of lateral and vertical force, and so additional roll does not effect precise steering. Coincident force centers also precludes the use of conventional sailboard sails and harness arrangements.

OBJECTS AND ADVANTAGES

Accordingly, several objects and advantages of the present invention are:

(a) to provide a hydrofoil sailboard having a freely ventilating supercavitating canard hydrofoil which will reliably track the water surface;

(b) to provide a hydrofoil sailboard which will be operable rolled to windward and without yaw;

(c) to provide a hydrofoil sailboard whose foil arrangement leads to a separation of the centers of lateral and vertical hydrodynamic force;

(d) to provide a hydrofoil sailboard which will be precisely and appropriately steerable by small changes in roll angle;

(e) to provide a hydrofoil sailboard which allows the use of conventional sailboard sails and harness arrangements.

Further objects and advantages will become apparent from a consideration of the drawings and ensuing description.

SUMMARY OF THE INVENTION

The invention is a canard configured hydrofoil sailboard meant to be operated rolled to windward, that has a freely ventilating supercavitating canard hydrofoil and a conventional subcavitating main hydrofoil arranged so that during operation, the canard hydrofoil tracks the water surface and the main hydrofoil rides fully submerged. The canard hydrofoil is hinged in roll so that it can be deflected to windward and locked. This combination leads to great pitch stability, precise steering, and the possibility of using conventional sailboard sails and harness arrangements.

DESCRIPTION OF THE DRAWINGS

Except as indicated, the drawings show our hydrofoil sailboard.

REFERENCE NUMERALS IN DRAWINGS

| | |
|---|---|
| 20 | sail assembly |
| 21 | board |
| 22 | universal joint |
| 30 | typical supercavitating hydrofofl profile |
| 31 | alternative supercavitating hydrofoil profile |
| 40 | main hydrofoil assembly |
| 41 | main hydrofoil |
| 42 | main hydrofoil anti-unroll fences |
| 43 | main support |
| 44 | main support ventilation fences |
| 45 | main hydrofoil with anhedral |
| 46 | main supercavitating hydrofoil |
| 47 | main support with truncated trailing edge |
| 50 | canard hydrofoil assembly |
| 51 | canard hydrofoil |
| 52 | canard support |
| 53 | canard support rod |
| 54 | canard mounting well |
| 60 | canard hinge assembly |
| 61 | canard hinge |
| 62 | canard hinge mounting plate |
| 63 | canard hinge shifting assembly |
| 64 | canard hinge locking mechanism |
| 65 | canard hinge latch |
| 66 | canard jibing cord |
| 67 | canard shifting cord |
| 68 | canard lock releasing cord |
| 69 | elastic member |
| 70 | attack angle adjustment assembly |
| 71 | attack angle hinge |
| 72 | attack angle spring |
| 73 | attack angle damper |
| 80 | canard hydrofoil having dihedral |
| 81 | canard hydrofoil having dihedral and two lateral pieces |
| 82 | canard hydrofoil having an arc-shaped forward projection |
| 90 | swiveling support fairing with rounded leading edge and broad and abruptly truncated trailing edge |

FIGS. 1–5—HYDROFOIL SAILBOARD—DESCRIPTION

Figure 1:
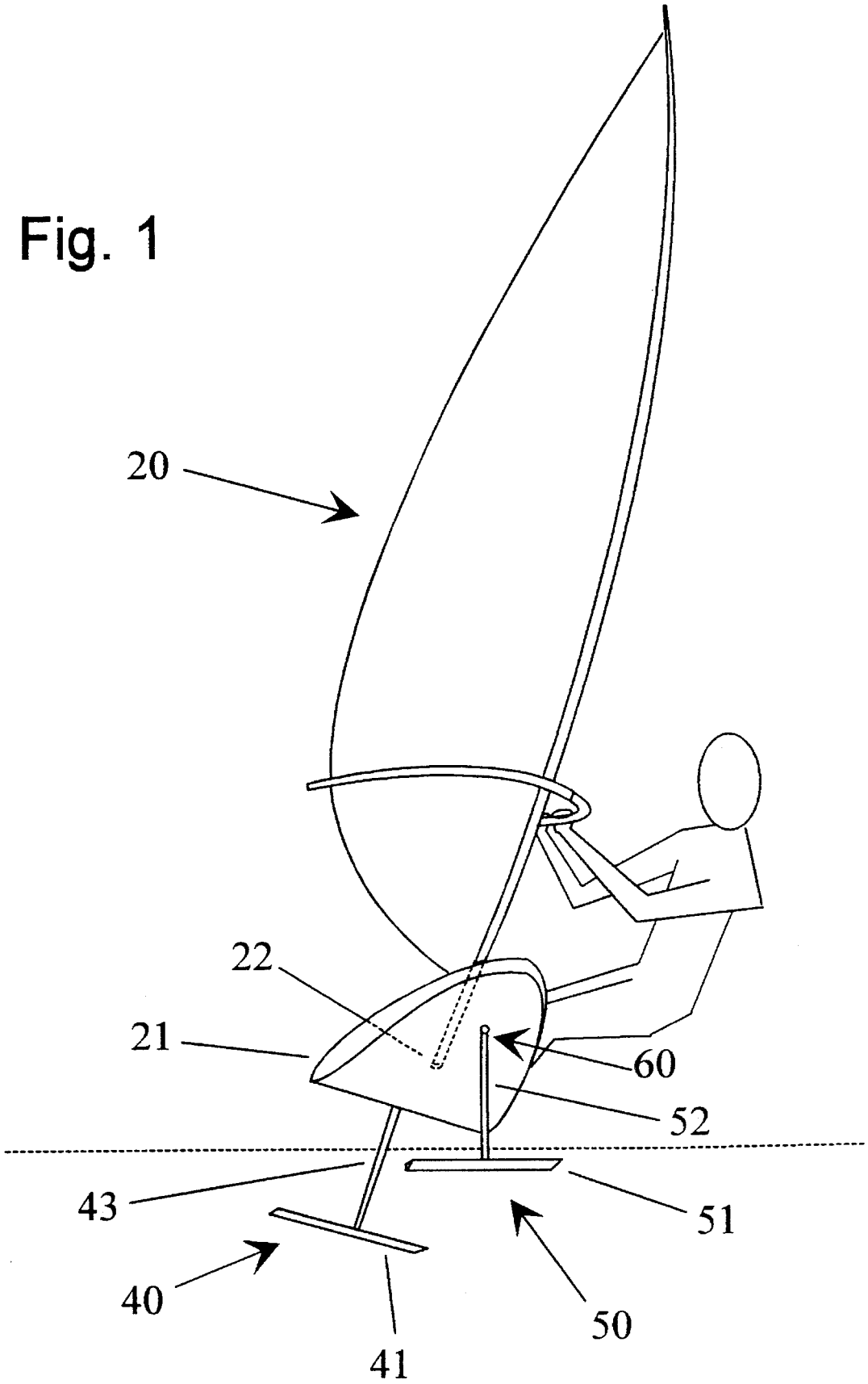
FIG. 1 is a perspective view from forward, and from slightly to leeward of the longitudinal axis, of a canard configured hydrofoil sailboard in normal operating position showing a hinged canard hydrofoil.
Figure 2:
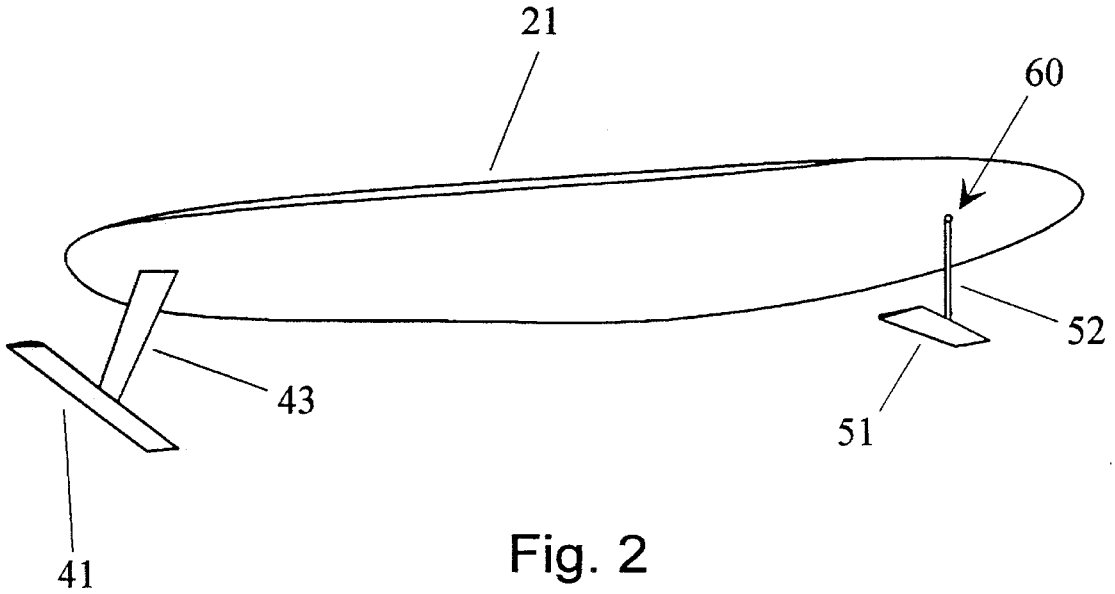
FIG. 2 is a perspective view from the front leeward quarter of the hydrofoil sailboard shown in FIG. 1.

FIGS. 1 and 2 show perspective views of our hydrofoil sailboard. A sail assembly 20 is attached to the upper side of a hull or board 21 by means of a universal joint 22. A main hydrofoil assembly 40 is mounted on the lower side of board 21 near its after end, and a canard hydrofoil assembly 50 is mounted on the lower side of board 21 near its forward end. Assembly 40 comprises a main hydrofoil 41 connected to board 21 by a main support 43.

Figure 5:
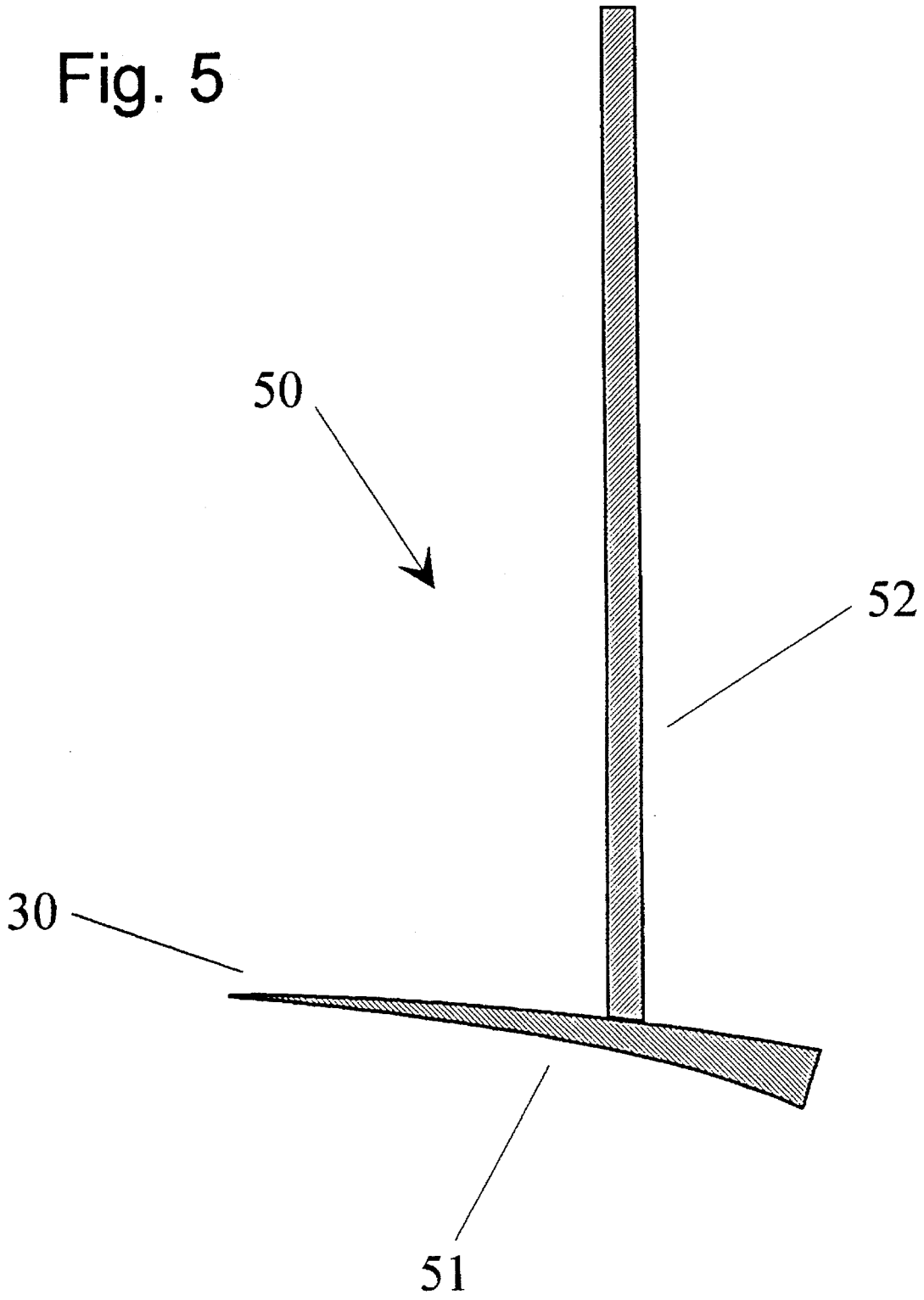
FIG. 5 is a sectional view through the longitudinal symmetry plane of the canard hydrofoil and support shown in FIG. 3.

Assembly 50 comprises a canard hydrofoil 51 of supercavitating type, having a profile 30 incorporating a sharp leading edge as shown in FIG. 5. Hydrofoil 51 has a flat forward projection (that is, is said to be without dihedral) and is rigidly connected to a round sectioned canard support 52. Support 52 is flexibly connected to board 21 by a canard hinge assembly 60 that comprises a mounting plate 62. A canard mounting well 54 is set into board 21 to accept plate 62 and an upward projection of support 52. A shifting assembly 63 and a locking mechanism 64 are attached to the upper part of well 54. Assembly 63 comprises a canard jibing cord 66, a canard shifting cord 67, a canard lock releasing cord 68, and an elastic member 69. Assembly 63 engages the projection of support 52 and moves it laterally. Mechanism 64 catches the projection and holds it to one side or the other.

The hydrofoils are arranged in a canard configuration, that is, with hydrofoil 41 larger than hydrofoil 51. Support 43 is longer than support 52. Thus, when board 21 is positioned with its longitudinal axis substantially level, and when it is rolled to windward as shown in FIG. 1, hydrofoil 41 is lower than hydrofoil 51 to the degree that when hydrofoil 51 is at the water's surface, hydrofoil 41 is fully submerged. Support 43 is provided with a number of ventilation fences **44*a* and 44*b*. Hydrofoil 41 is provided with a pair of anti-unroll fences 42*a* and 42*b*. Support 43 is shaped and sized at its upper end to fit into heavy-duty sailboard fin box (not shown) that is set into board 21. A slot (not shown) is provided in board 21 to receive universal joint 22**.

The specific degree of angular deflection of support 52 allowed by hinge assembly 60 is important and the way to make the proper choice is discussed below.

OPERATION—FIGS. 1–5

The hydrofoil sailboard works in generally the same way as the device disclosed in Miller, above. In particular, when the craft is not in motion, board 21 rests in the water, supported by buoyant forces alone. Hydrofoils 41 and 51 are fully submerged. As the craft picks up speed, hydrodynamic forces generated by the hydrofoils tend increasingly to lift the board. At a speed that depends on many factors, but primarily hydrofoil area and the weight of the craft and sailor, the lift from the hydrofoils becomes sufficient to lift board 21 entirely free of the water. This lifting out of the water is called takeoff. At takeoff, canard hydrofoil 51 rises to the water surface, and, at least in flat water, remains there. Main hydrofoil 41 follows the canard hydrofoil upward, but stabilizes while still submerged, at a depth that depends on the angle of attachment between it and the craft's longitudinal axis, call its rigging angle, the relative lengths of main support 43 and canard support 52, the relative size and loading of the main and canard hydrofoils and the profile of the main hydrofoil. These factors can be chosen so that the bulk of the load is carried by the main hydrofoil operating at an attitude and depth that maximizes speed or optimizes handling. The absolute lengths of the main and canard supports can be chosen to set wave clearance. Because it is freely ventilating and supercavitating, the canard hydrofoil tracks the water surface reliably so that the main hydrofoil remains at the chosen depth. Thus, variations in canard hydrofoil submersion due to wave encounters and variations in canard hydrofoil loading due to wind puffs do not tend to cause the board to crash into the water.

When operating in waves, the hydrofoil sailboard is meant to be sailed so that canard hydrofoil 51 drives through wave crests, alternately being fully submerged and completely airborne. This method of operation allows main hydrofoil 41 to keep a more constant height than it would if the canard hydrofoil always stayed precisely on the surface. The more lightly the canard hydrofoil is loaded, the more closely it will track the surface; that is, the less it will drive into each wave. The sailor is meant to choose a loading that is appropriate to the conditions at hand. The rigging angle of the canard also affects the degree of surface tracking. Canard support 52 should be adjustable for fine tuning of the rigging angle.

The hydrofoil sailboard is meant to be sailed rolled to windward and without yaw, as shown in FIG. 1. In order to completely eliminate yaw, the lateral hydrodynamic force to windward from the combination of main and canard hydrofoils, which ultimately derives from the combined weight of the sailor and craft, coupled through the roll angle, must exactly balance the lateral aerodynamic force to leeward. The aerodynamic force is generated primarily by the sail and to a lesser extent by drag forces on the board and sailor. Since the lateral force from the sail is to some extent adjustable by changing the sail attitude, there ends up being some choice in roll angle. The sailor can choose to lean hard to windward and sail at a higher roll angle or lean less and sail less rolled. It is part of the sailor's skill to choose appropriately.

As shown in FIGS. 1–5, the hydrofoil sailboard includes canard hinge assembly 60 that allows canard support 52 to be deflected and locked to one side. The amount of deflection is determined, to first approximation, so that when the board is rolled optimally as discussed in the previous paragraph, canard hydrofoil 51 rides level with the water surface. The design of locking mechanism 64 is easy in view of the current mechanical art.

Figure 3:
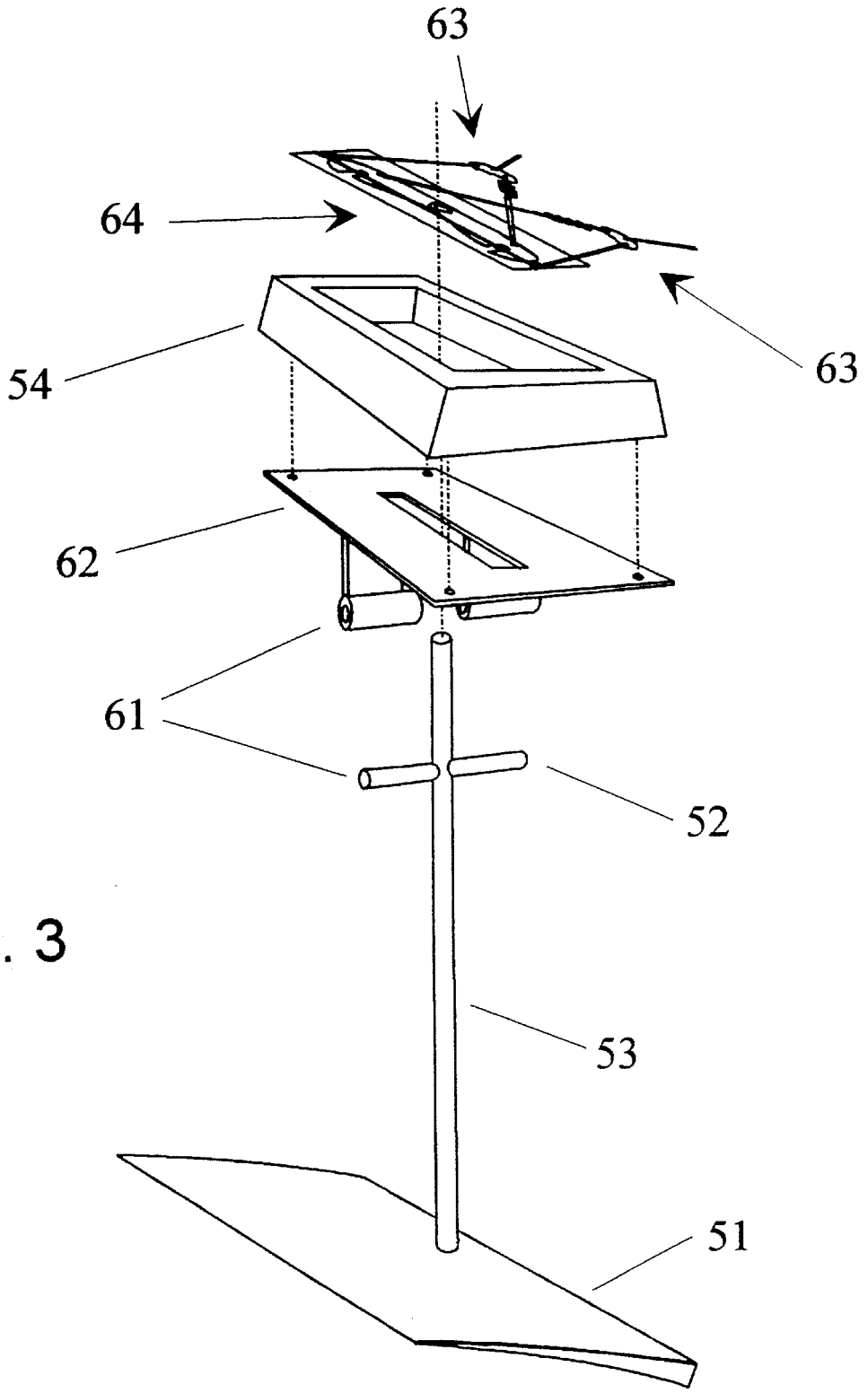
FIG. 3 is an exploded view of the canard hydrofoil assembly shown in FIG. 1.
Figure 4:
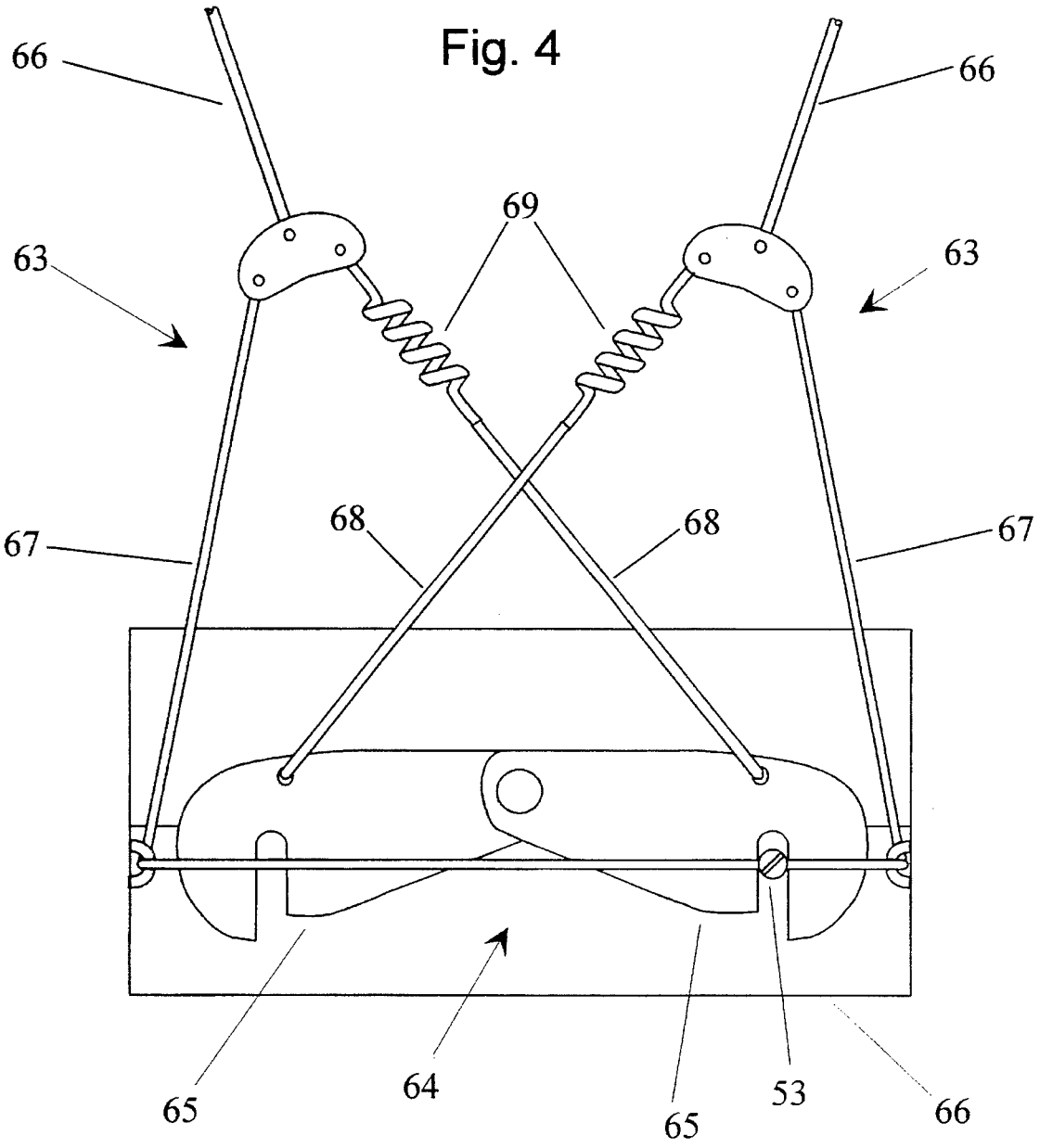
FIG. 4 is a top view of the locking mechanism shown in FIG. 3.

A sailing craft operated so that the wind blows over one side is said to be on a tack. It is important for a sailing craft to be able to steer from one tack to the other. The steering maneuver for changing tacks in which the wind passes behind the craft is call a jibe. For modern conventional sailboards, the preferred method of changing tacks is by jibing. The hydrofoil sailboard shown in FIGS. 1–5 is capable of being jibed in the same manner as modern conventional sailboards, and during the jibe, canard support 52 may be left locked in its pre-jibe deflection. However, at the end of the jibe, before the sailor is able to start off on the new tack, the canard support must be released, moved to its other deflection, and locked there FIGS 3 and 4 show shifting assembly 63, which works in conjunction with hinge assembly 60 and locking mechanism 64 to accomplish this repositioning. The shifting assembly works in this way: Latches 65 pivot in the plane of FIG. 4 to engage or release the projection of support 52. Normally latches 65 are positioned as shown, and held in place by springs (not shown). FIG. 4 depicts the support projection locked to the right. When, in this configuration, the left-hand jibing cord 66 is pulled toward the top of the FIGURE, tension is applied simultaneously to the associated releasing cord 68 and shifting cord 67. Right-hand latch 65 pivots toward the top of the FIGURE, releasing the projection of support 52, which then moves to the left under the influence of left shifting cord 67. The interposed elastic member 69 elongates, allowing the projection to be drawn to the left until it engages left-hand latch 65 and is captured. The repositioning operation can be foot actuated, or can be driven by an operation on the sailboat rig. Particularly elegant is the use of the jibing of the sail rig itself to effect the repositioning.

ADVANTAGES—FIGS. 1–5—SURFACE TRACKING

The advantages of our hydrofoil sailboard over previous devices derive partially from the use of a freely ventilating supercavitating canard assembly as shown in FIG. 5. Most importantly, such an assembly tracks the water surface more effectively than the ones employed before. Effective surface tracking allows high pitch stability, efficient main hydrofoil use, and excellent performance in waves.

Although freely ventilating supercavitating hydrofoils obviously do not suffer from plunging due to adventitious air bubble attachment, it was, before our experiments with them, far from clear whether their well known drawbacks would overwhelm any benefit obtained from plunging elimination. It turns out, in the context of a surface tracking canard on a craft as tiny as a hydrofoil sailboard, that the disadvantages taught in the prior art become unimportant.

A first disadvantage is the notorious inefficiency of supercavitating hydrofoils. In our hydrofoil sailboard such inefficiency is minimized both by the light loading of canard hydrofoil 51 and by the fact that for much of the time in waves, and all the time in fiat water, the canard hydrofoil rides in a high planing mode at the water surface, with only a small part of its lower side in contact with the water.

A second disadvantage is the difficulty in initiating and stabilizing an air cavity on the upper surface the of the hydrofoil. In the present invention, due to the small size of the hydrofoil sailboard, and, in particular, to the short length of canard support 52, canard hydrofoil S 1 is physically constrained from getting more than several inches below the water surface. Thus, even at relatively low speeds, suction at the top of hydrofoil 51 is sufficient to form a stable cavity from atmospheric air.

A third disadvantage is the erratic effect of the mode change instability between planing operation and fully ventilated operation described by Dobay, above. In the hydrofoil sailboard it is ameliorated by the small chord, that is, fore-and-aft dimension, of canard hydrofoil 51. The described mode change is only possible at hydrofoil submersions which support planing operation, which, according to Dobay, means depths less than one foil chord. Since foil lift coefficient increases (dramatically) under transition between planing mode and fully ventilated mode, at worst, such a transition would cause canard hydrofoil 51 to suddenly drop a few inches from the surface, or, if it occurs in the opposite direction, to suddenly rise from a small depth to the surface. In either case, main hydrofoil 41 would quickly follow the lead of the canard. This amount of change would not be catastrophic at speeds likely to be obtained by a wind powered craft. Larger hydrofoil lift changes occur every time a high planing canard runs into a wave.

A fourth possible disadvantage, the effect of differential transition, thence lift, between the two sides of the canard hydrofoil that was so significant for FRESH-I is of small consequence here because of very large rolling moments from board and sailor, combined with major roll damping from the sail.

Our hydrofoil sailboard makes use of a round canard support rod 53 without any streamlined fairing. This is possible precisely because there is no need to prevent ventilation along the support to the canard hydrofoil. Indeed, such ventilation is essential, and the wake of the round rod provides an excellent and simple path.

FURTHER ADVANTAGES—FIGS. 1–5—STEERING AND SAIL BALANCE

Operating the hydrofoil sailboard without yaw has two important advantages: first, the tendency of main hydrofoil 41 to ventilate via an air path along main support 43 is decreased; and second, drag due to wave making where support 43 penetrates the water surface is minimized.

As indicated above, with the board rolled normally to windward, canard support 52 is deflected and locked in such a way that canard hydrofoil 51 rides level with the water surface. In this position, hydrofoil 51 produces no lateral force. This leads to a minor benefit and a major one. The minor benefit is that proportion of the total hydrodynamic force generated by the more efficient, submerged, conventional main hydrofoil 41 is increased. The major benefit is that the center of vertical hydrodynamic force is separated and moved forward from the center of lateral hydrodynamic force. This is the same hydrodynamic situation that obtains with modern sailboards without hydrofoils, and has the very important corollary that our hydrofoil sailboard is able to use ordinary sailboard sails and harness arrangements.

Because the hinged canard hydrofoil as shown in FIGS. 1–5 is actually locked into its deflected position, two more important benefits accrue. The first is that board steering is much improved, not only compared to previous hydrofoil sailboards, but compared to conventional sailboards as well. The improvement comes about since slight increases beyond the normal board roll angle cause steering torques to windward from the canard hydrofoil that overwhelm those to leeward from the main hydrofoil. The second benefit from the locked canard support is that a small mount of unroll of the board from its normal position can be used to move the center of lateral hydrodynamic force aft of the location of the main hydrofoil. This displacement of the hydrodynamic center allows a similar aft displacement of the center of lateral aerodynamic force from the sail. That displacement, in turn can be accomplished by increasing the rearward lean, called rake, of the mast. Increased rake is salutary in that it allows the slot between the sail foot, or lower edge, and the board to be closed, leading to improved sail efficiency.

These last sail balance and steering effects are much enhanced by secure surface tracking by the canard hydrofoil.

FIG. 6—ATTACK ANGLE ADJUSTMENT

Figure 6:
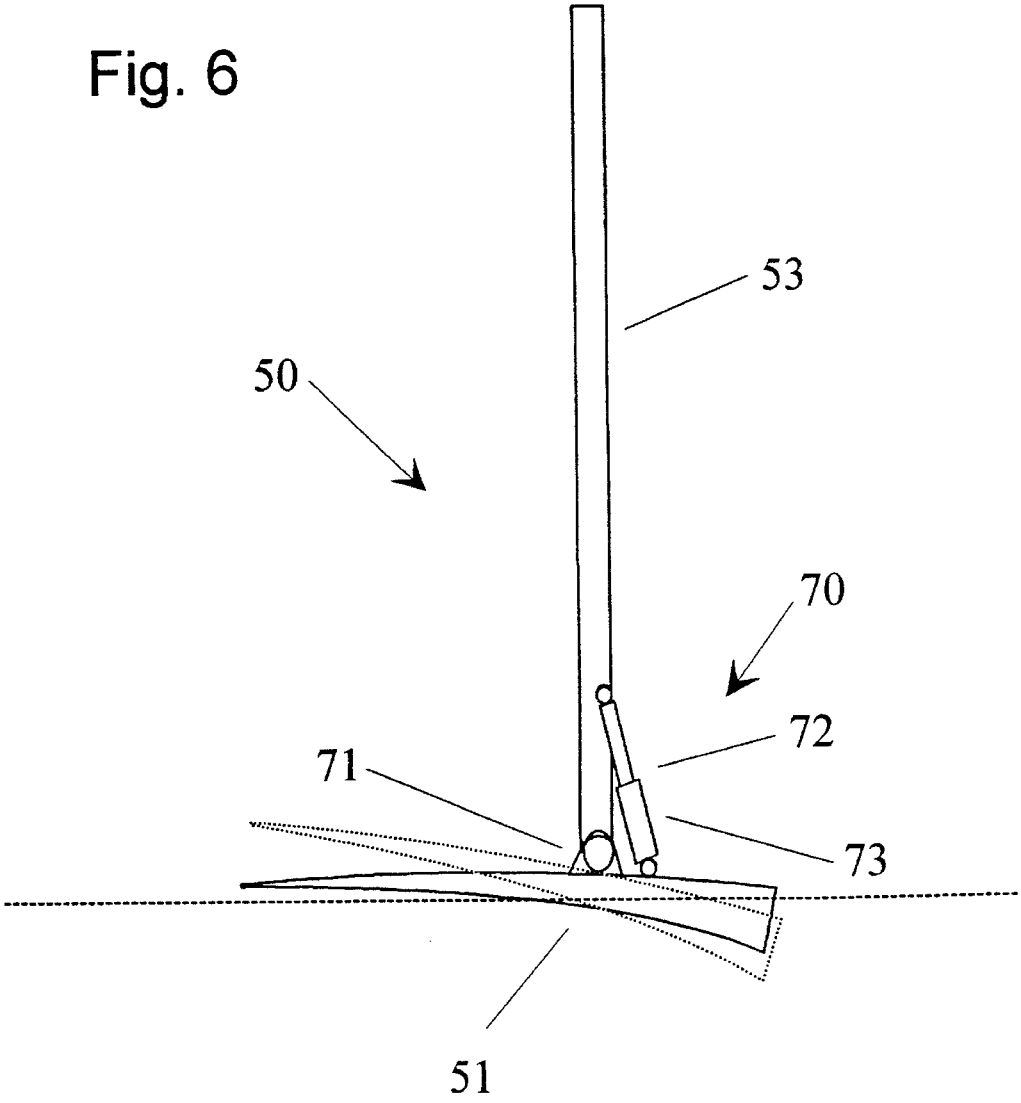
FIG. 6 is a side view of a canard hydrofoil and support equipped with a hinge and damping mechanism.

A ramification of the hydrofoil sailboard, shown in FIG. 6, is the addition of an attack angle adjustment assembly 70, which, in the FIGURE, is located at the junction of the canard hydrofoil and its support. Assembly 70 is designed so that the angle of the canard hydrofoil can be varied relative to its support. Since the hydrofoil sailboard operates in a steady attitude relative to the water, setting this angle effectively sets the canard hydrofoil attack angle. The embodiment of assembly 70 shown comprises a hinge 71, a spring 72, and a damper 73. By appropriate configuration of these elements, the canard hydrofoil can be made to automatically sense its immersion state and change its attack angle accordingly, reducing the angle for more efficient operation when on the surface, and increasing it for more resistance to being driven downward when submerged. The design and construction of such an assembly is straight forward in the current mechanical art.

FIG. 7—ALTERNATIVE CANARD PROFILE

Figure 7:
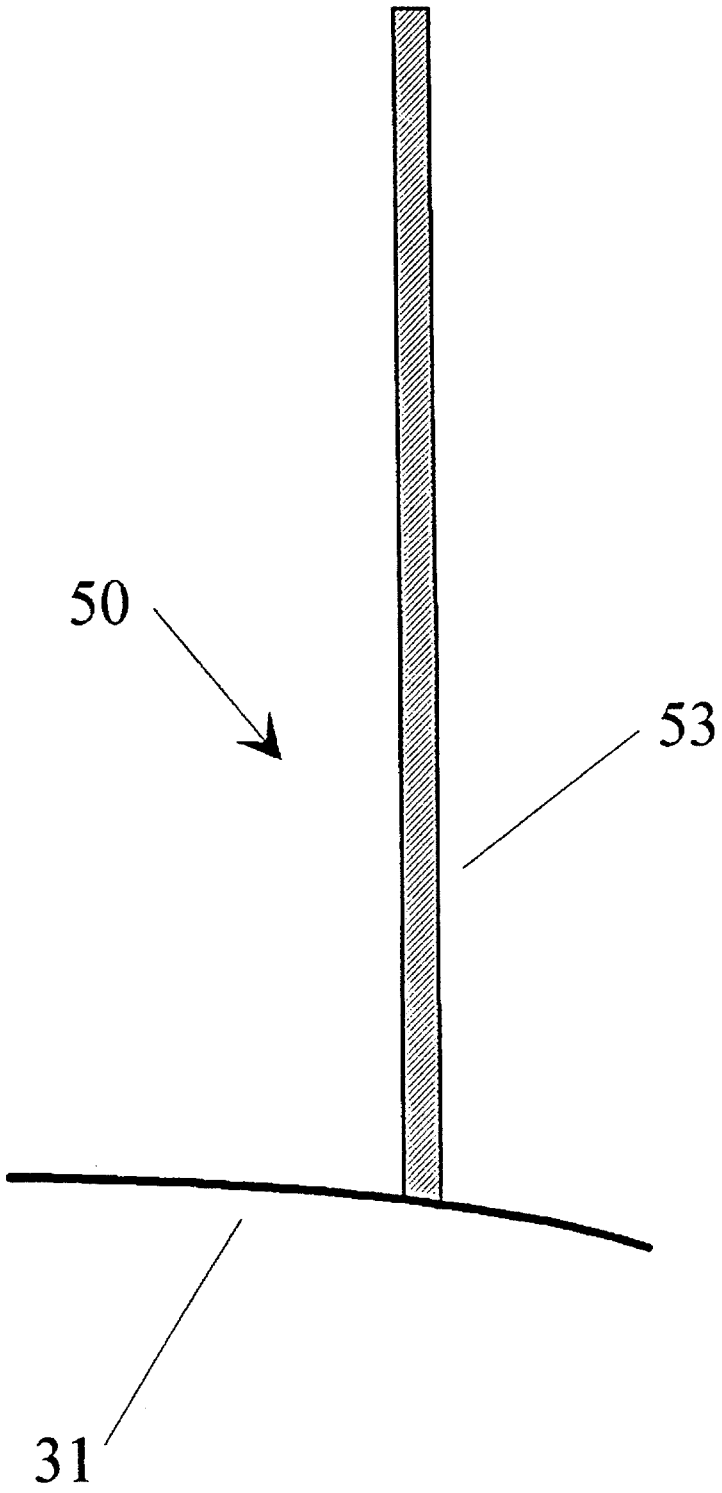
FIG. 7 is a sectional view through the longitudinal symmetry plane of a freely ventilating supercavitating canard hydrofoil assembly showing an alternative hydrofoil profile having positive camber and uniform thickness.

An alternative canard profile 31 shown in FIG. 7 may be used. Especially if designed without dihedral, such a hydrofoil would be easy to manufacture. Because, under the same conditions of attack and speed, the cavity developed by a hydrofoil with this sort of profile has more volume along the top surface of the hydrofoil compared to the typical profile 30 shown in FIG. 5 (cavity replaces solid foil material), a full cavity extending all the way to the leading edge might be more stably maintained. Against these advantages, hydrofoils of this sort will be inherently less stiff than those having profile 30.

FIG. 8—HYDROFOIL SAILBOARD—FIXED CANARD HYDROFOIL HAVING DIHEDRAL

Figure 8:
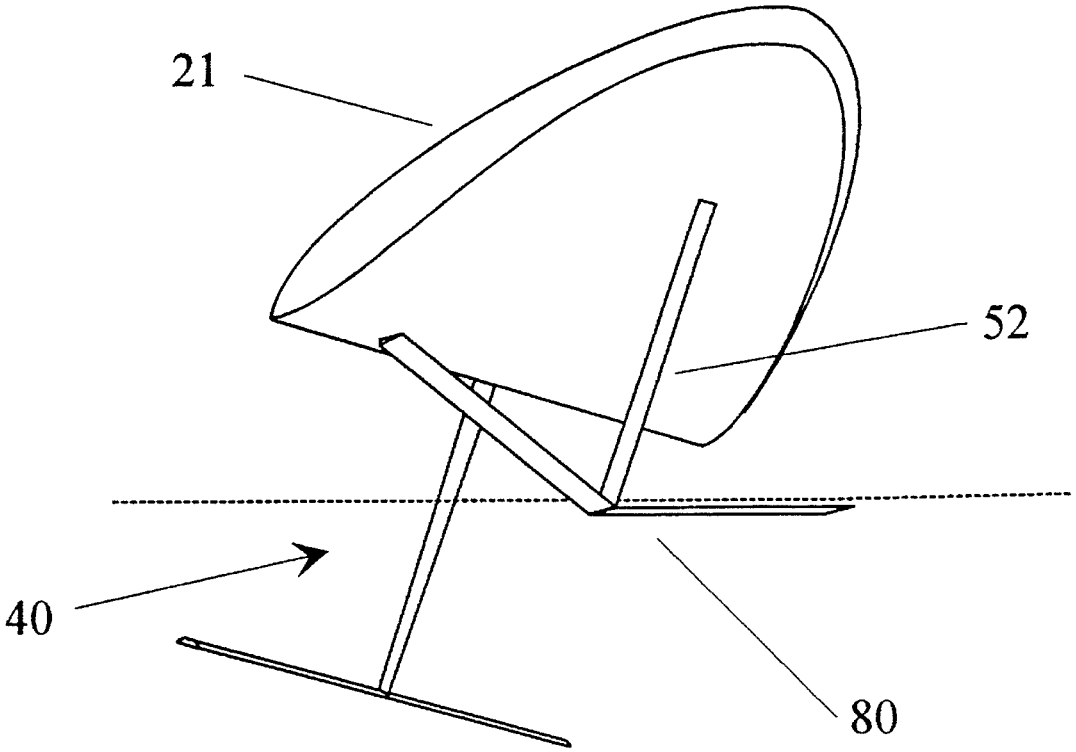
FIG. 8 is similar to FIG. 1 but shows a canard hydrofoil having dihedral.

Another ramification, shown in FIG. 8, is the replacement of the hinged canard assembly by a fixed one that includes a canard hydrofoil with dihedral 80. In this ramification, the canard support length and the canard hydrofoil dihedral angle must be chosen according to the constraint that during normal operation, when the hydrofoil sailboard is rolled the appropriate amount to windward, the windward half of the canard hydrofoil rides level with the water surface, and the leeward half rides clear of the water. Satisfying this constraint requires that the canard hydrofoil have a very significant amount of dihedral. So much, in fact, that if the hydrofoil were operated upright and not rolled, the losses from countervailing lifts from the two lateral sides of the hydrofoil would generally be considered prohibitive. It is only because one of the sides rides clear of the water that this configuration is feasible.

In theory, a hydrofoil having dihedral and profile uniform along its span, when operated so that both tips are out of the water, will produce a purely vertical lift vector, no matter what its degree of roll. This property fails when either tip becomes submerged, when the hydrofoil is operated in yaw, or when surface effects come into play. This theory is not likely to have practical consequences in the design of a small subcavitating canard hydrofoil meant to be operated in surface tracking mode, because, in that case, non-uniformizing surface effects, primarily involving hydrofoil ventilation, come into play. However, with a freely ventilating supercavitating hydrofoil, ventilation is made effectively uniform, and the theory takes on useful significance.

If the hydrofoil sailboard shown in FIG. 8 is rolled further to windward than its normal operating position, it, like the embodiment with locked hinged canard, steers briskly to windward. However, the theory implies that if the craft is rolled the other way, no such strong steering takes place to leeward. Steering to leeward would have to be contrived by means of a change in sail position. For this same reason, unroll could not be traded off against increased rake of the rig in order to close the slot between the sail foot and the board. These are important losses. Also, behavior in waves is degraded since occasional immersion of the canard beyond its usual operating position causes the previously clear side of the canard hydrofoil to contact the water and to lift with the effect that the craft steers suddenly and perhaps severely to windward. On the other hand, the use of a fixed canard hydrofoil with dihedral, in addition to being simpler to build and maintain since it has no moving parts, has the great advantage over a hinged canard assembly in that the sailor need take no action during the jibe beyond that required for conventional sailboards.

FIG. 9—HYDROFOIL SAILBOARD—TWO-PIECE FIXED CANARD HYDROFOIL

Figure 9:
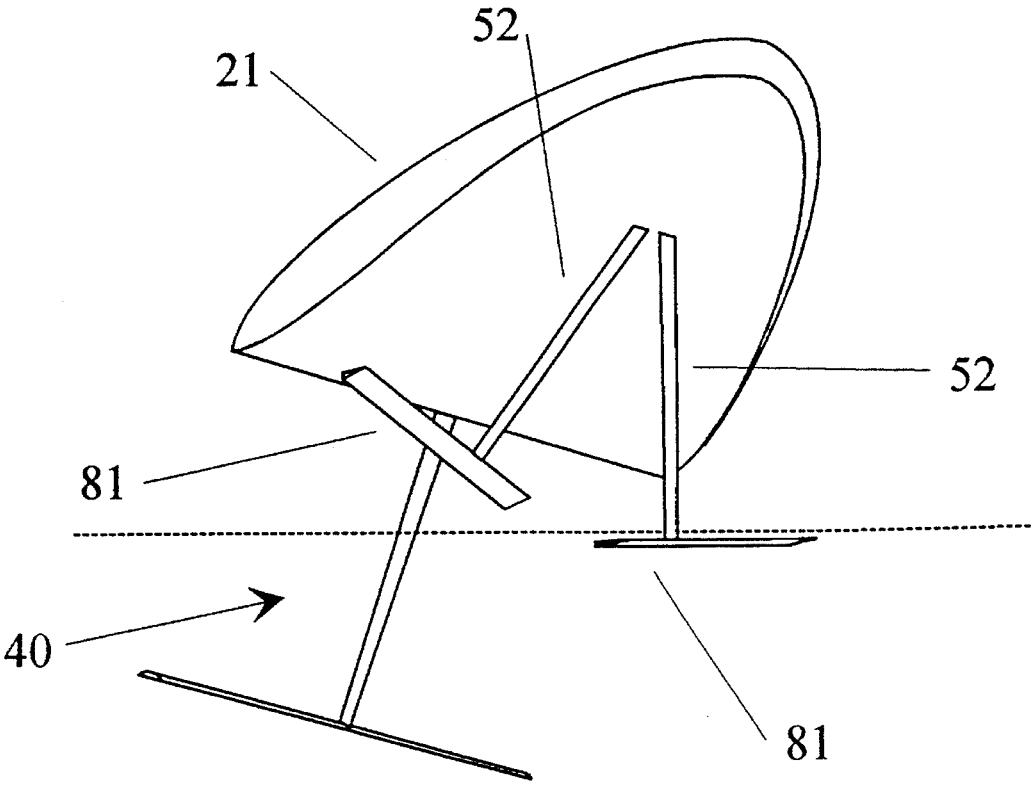
FIG. 9 is similar to FIG. 8 but shows a canard hydrofoil having two separated halves.

Another ramification, shown in FIG. 9, is conceptually just like the previous one except that a two-piece canard hydrofoil with dihedral 8 1 is used. The two lateral halves of the canard hydrofoil, while maintaining dihedral angle, are separated by a significant amount at the craft's keel plane. Of course, the separation requires a more elaborate, two piece support system, but this ramification avoids or minimizes all the drawbacks of the previous one, while maintaining all the important benefits. In particular, slight unroll of the hydrofoil sailboard from its normal position, here, as in the case of the hydrofoil having locked hinged canard, causes effective steering to leeward, and here the steering can be traded off against sail rake to close the slot. Also, the separation between the lateral halves of the canard hydrofoil allow the operating half to become completely submerged before the other half contacts the water, decreasing the frequency of unwanted upwind steering lurches in waves. The separation between the two halves of this ramification defeats the above theory, and although, when this craft is unrolled to the point that the leeward canard hydrofoil half contacts the water, the steering effect decreases, it never becomes entirely neutral as it does in the previous ramification. This ramification, like the previous one requires no special attention by the sailor during a jibe, and because the steering does not go neutral except when the craft is completely straight up, it allows the sailor continuous board steering through the jibe.

FIG. 10—HYDROFOIL SAILBOARD—ARC-SHAPED FRONTAL PROJECTION

The above theoretical observation about hydrofoils with dihedral easily generalizes to the case of those having polyhedral, which means being made of a number of pieces, with adjacent pieces joined at an angle. In fact, it generalizes to the limiting case of any hydrofoil with uniform profile, no matter what shape its forward projection has. In particular, it applies to uniform profiled hydrofoils whose frontal projection is arc shaped.

Figure 10:
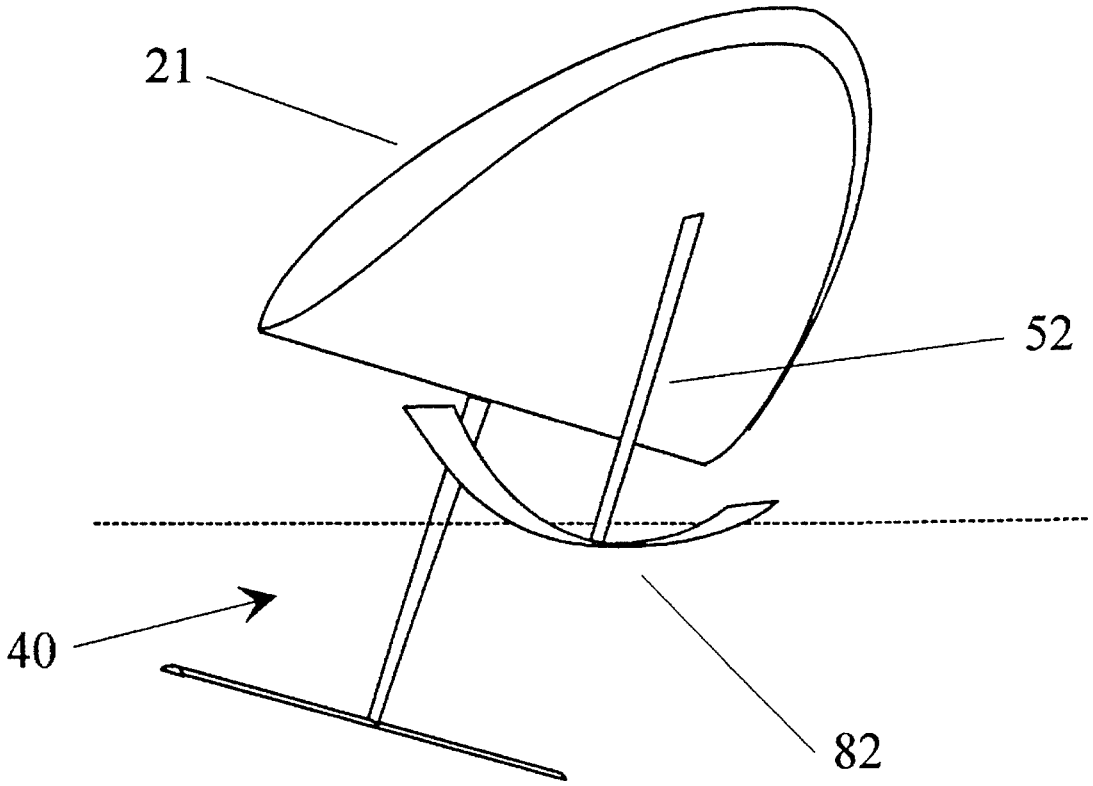
FIG. 10 is similar to FIG. 8 but shows a canard hydrofoil having an arc-shaped frontal projection

A ramification of the hydrofoil sailboard, shown in FIG. 10, is the replacement of the canard hydrofoil having dihedral shown in FIG. 8, with one having arc-shaped frontal projection 82. This ramification has properties nearly identical to those of the ramification of FIG. 8, except that performance will generally be somewhat less crisp. This is appropriate when more forgiving performance is desired, as in a craft meant for learning the requisite skills.

FIG. 11—MAIN HYDROFOIL—ANTI-UNROLL VENTILATION FENCES

Figure 11:
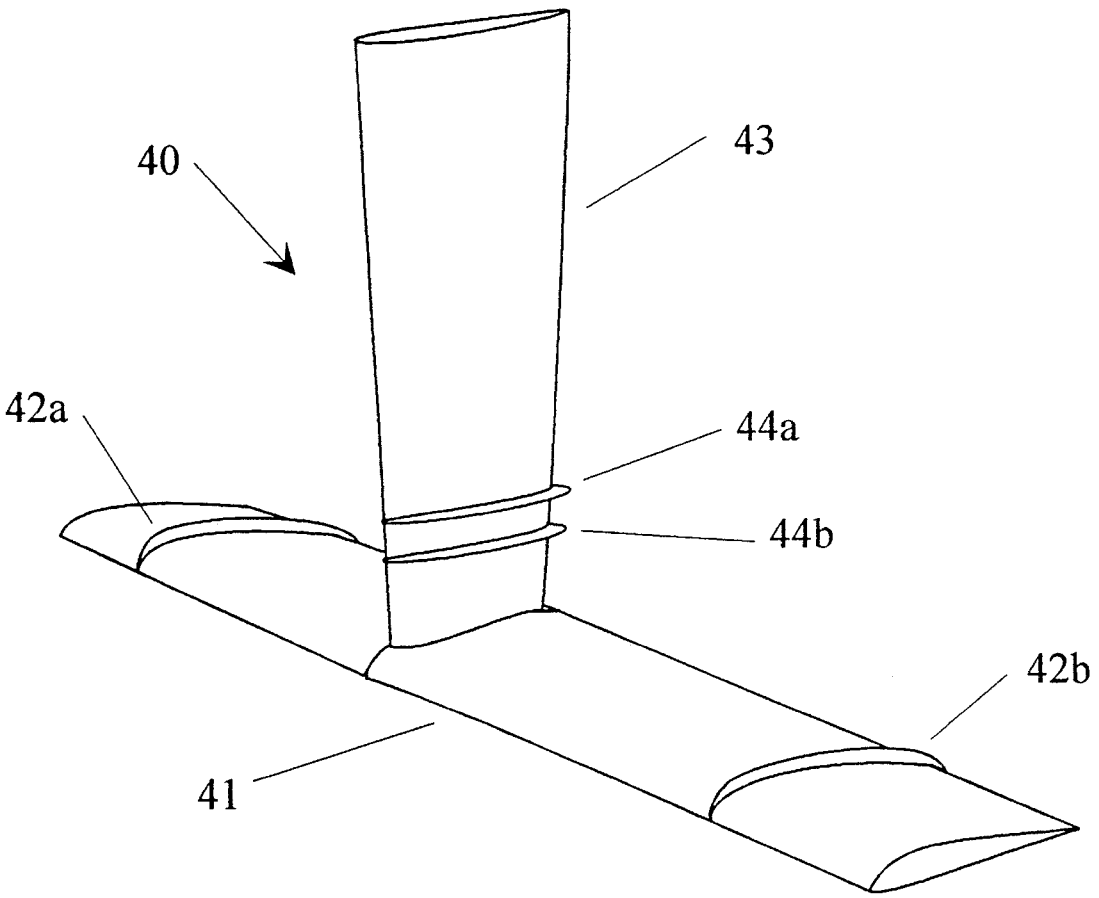
FIG. 11 is a perspective view of a main hydrofoil assembly showing a main hydrofoil equipped with anti-unroll ventilation fences and a main support equipped with ventilation fences

Another ramification, shown in FIG. 11, is the addition of a pair of ventilation fences 42*a* and 42*b*, to the main hydrofoil. The fences are symmetrically located part way in from the hydrofoil tips, and are positioned so that if during normal rolled operation, one of the hydrofoil tips breaks the water surface, ventilation along the foil from that tip is restricted to the region between the tip and the fence. This causes a partial loss of hydrofoil lift in that region, and leads to a relatively controlled unrolling of the craft as a whole, which has the effect of resubmerging the tip. In the absence of the ventilation fence, the entire side of the main hydrofoil between the affected tip and the location of attachment of the main support ventilates and the craft goes so far and quickly out of balance that capsize to leeward is unavoidable.

FIG. 12—MAIN HYDROFOIL—ANHEDRAL

Figure 12:
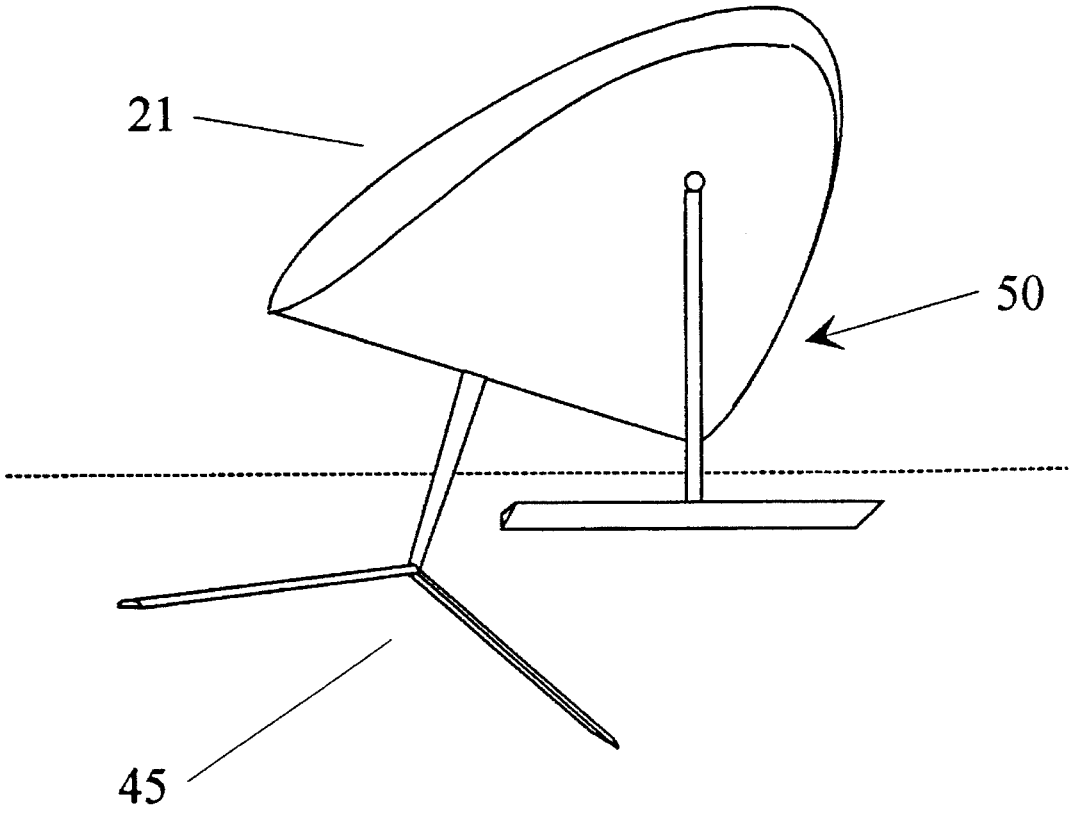
FIG. 12 is a perspective view of a main hydrofoil assembly showing a main hydrofoil comprising anhedral (negative dihedral).

Another ramification, shown in FIG. 12, is the use of a main hydrofoil with a modest amount of downward dihedral, often called anhedral 45. Addition of anhedral would make complete foil submersion in the presence of roll and waves more likely. Especially if it had short span, a hydrofoil of this design can allow the elimination of fences 42 of the previous ramification.

FIG. 13—MAIN HYDROFOIL ASSEMBLY—FREELY VENTILATING SUPERCAVITATING

Figure 13:
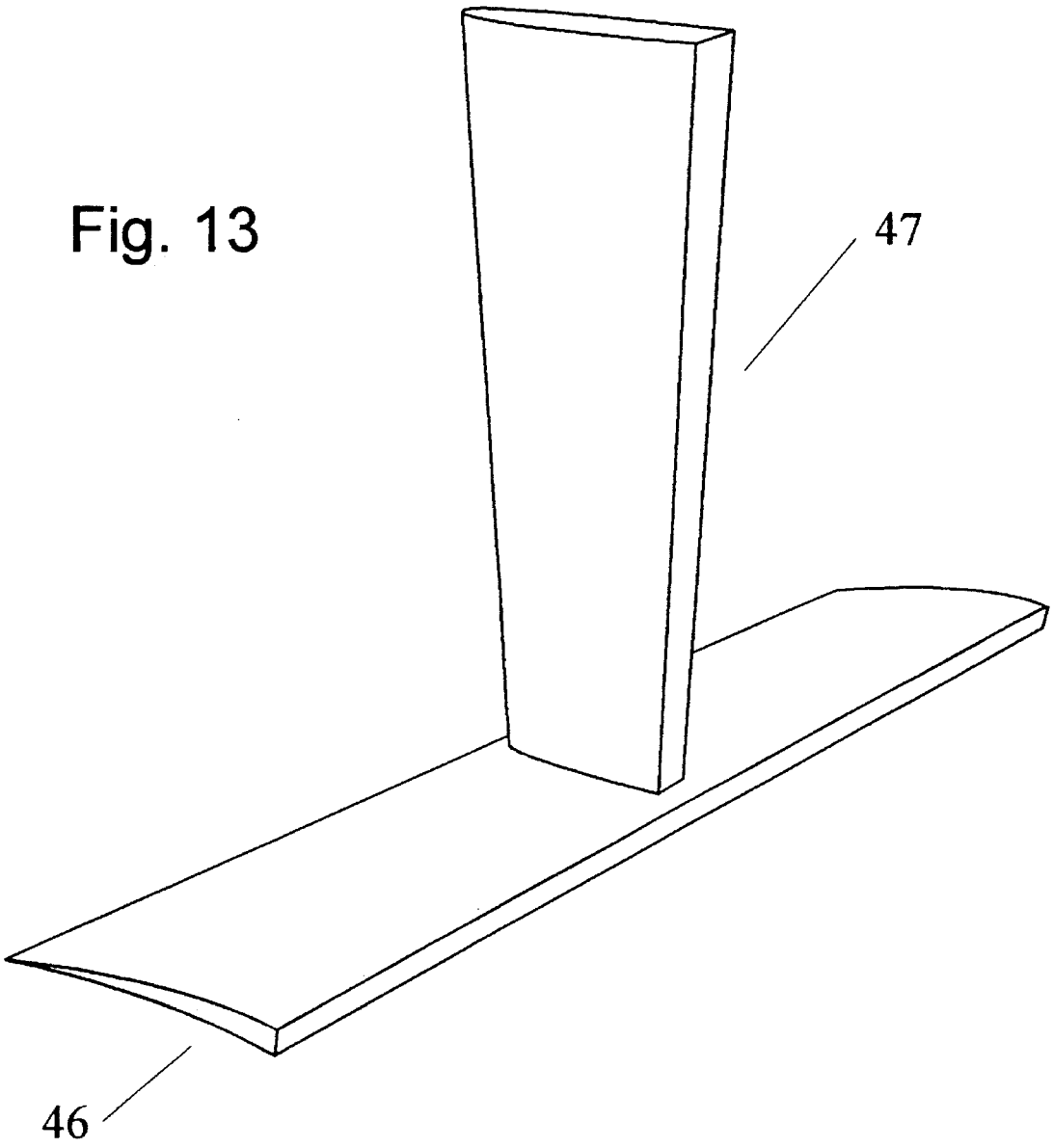
FIG. 13 is a perspective view of a main hydrofoil assembly showing a main hydrofoil of freely ventilating supercavitating type and a main support with truncated trailing edge.

Another ramification, shown in FIG. 13, is the use of a main hydrofoil 46 of freely ventilating supercavitating type and a main support 47 that provides a ventilation path from the atmosphere to the main hydrofoil. The use of such a main hydrofoil assembly is indicated for very high speed operation, where a conventional main hydrofoil would cavitate spontaneously. The use of a freely ventilating supercavitating main hydrofoil at these speeds is essential, since the erratic operation of an adventitiously cavitating main hydrofoil would render the hydrofoil sailboard uncontrollable. The penalty for going to a supercavitating hydrofoil is serious loss of efficiency.

FIG. 14—MAIN HYDROFOIL ASSEMBLY—TWO SUPPORTS

Figure 14:
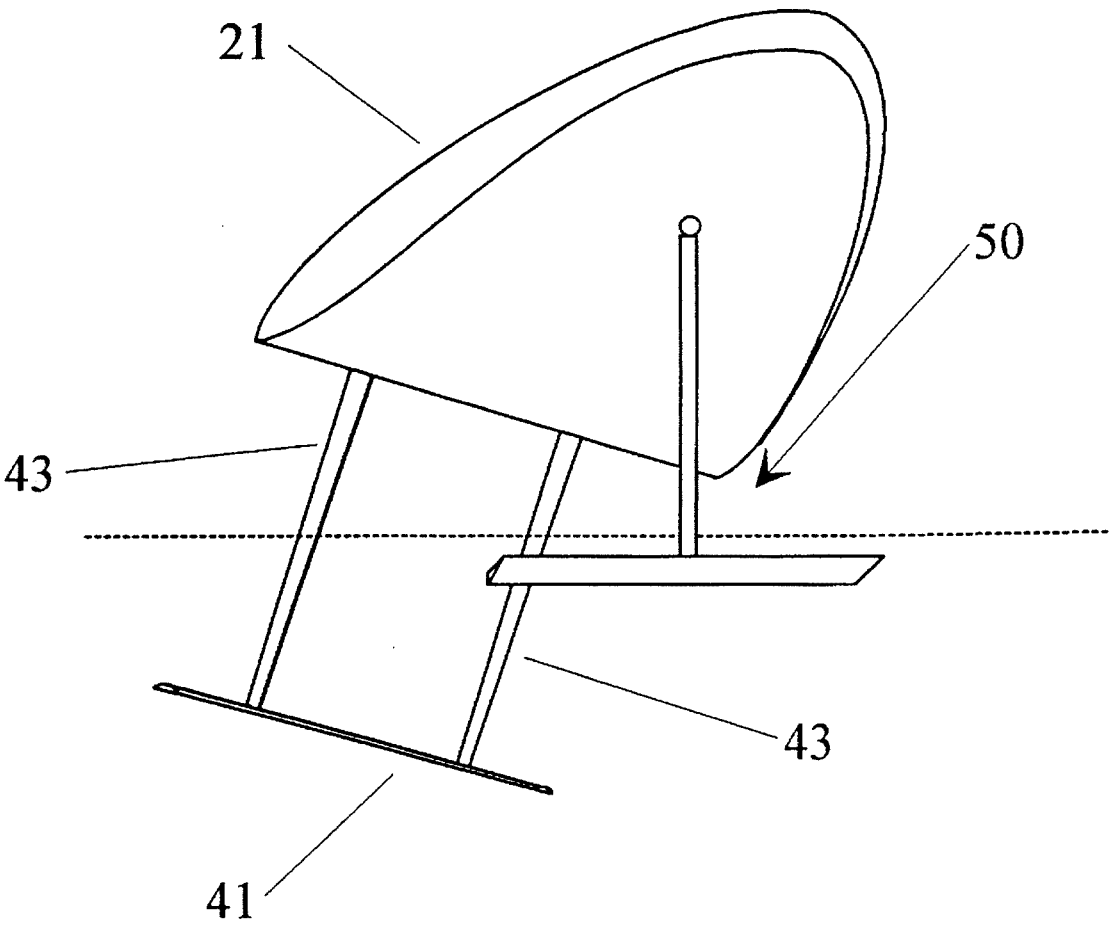
FIG. 14 is a perspective view from below of a hydrofoil sailboard have a main hydrofoil with two supports.

Another ramification, shown in FIG. 14, is the replacement of main support 43 by a two-piece version. Compared to a single support, two supports provide greater inherent structural strength, eliminate the need for main hydrofoil anti-unroll fences, and because the two supports act as very effective main hydrofoil endplates, reduce vortical drag at high lift coefficients. On the other hand, there is more skin and wave making drag.

FIG. 15—CANARD HYDROFOIL ASSEMBLY—SWIVELING FAIRING

Figure 15:
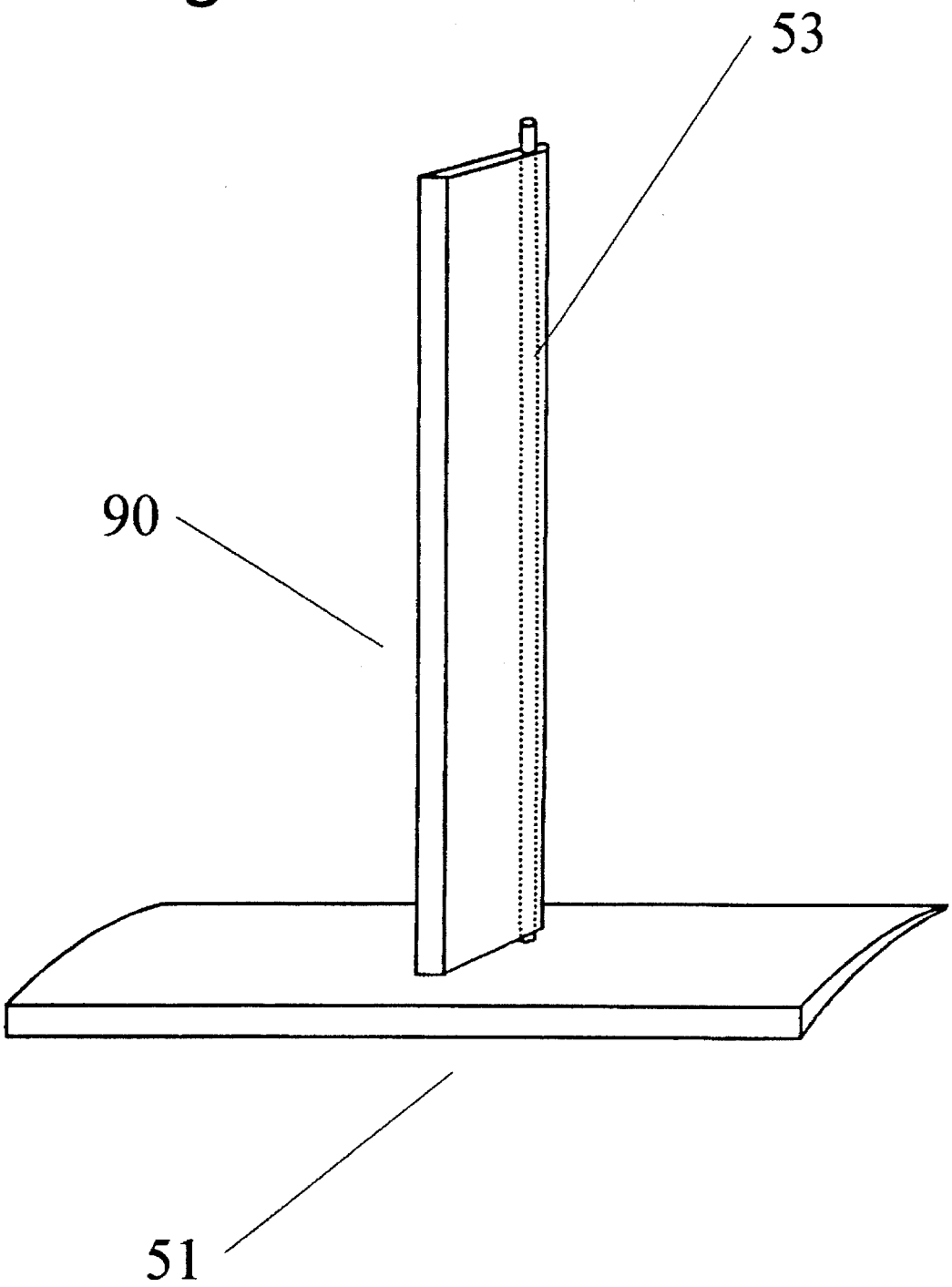
FIG. 15 is a perspective view of a canard hydrofoil assembly showing a swiveling fairing on the support rod. The fairing has a broad and abruptly truncated trailing edge.

FIG. 15 shows a canard hydrofoil assembly with a swiveling fairing 90 on support rod 53. The fairing has a broad and abruptly truncated trailing edge. Such a fairing provides in its wake a better ventilation path to the hydrofoil than is available from a bare round support rod. Because it swivels on the rod, fairing 90 trails in the surrounding water flow, so the desirable condition that the canard support not maintain lateral force is satisfied.

CONCLUSION, RAMIFICATIONS, AND SCOPE

Thus the reader will see that the hydrofoil sailboard of the invention provides a sail powered watercraft that capable of sustained, stable, smooth, high-speed foilborne operation, which can be sailed in much the same way as a conventional sailboard, using conventional sailboard sails and harness arrangements.

While what has been described is at present considered to be the preferred embodiments of this invention, it will be obvious to those skilled in the art that various changes and modifications may be made therein without departing from the invention.

For example, the hydrofoils can have other dimensions, other shapes, and other profiles, including blunt-nosed and cambered ones; the canard hinge assembly can have other forms of hinge and other hinge locations, including being located at the junction of the canard hydrofoil and the canard support; the locking mechanism and shifting assembly can be of any design that achieves the function described; the shifting mechanism can be eliminated or incorporated with the locking mechanism; the locking mechanism can be eliminated at a cost in performance.

The canard hinge locking mechanism can be replaced by a bistable mechanism that holds the canard support to one side or the other, but does not actually lock it there. Instead, such a mechanism holds the canard against a certain amount of force, but when that force is exceeded, allows the canard to swing to the other side. In operation, the canard remains rolled to windward as in the locked case, but as a result of forces applied during the jibing maneuver, the canard releases and springs automatically to the other side. Multistable mechanisms, that show the above behavior and give the sailor a choice of windward deflections suitable for various sailing conditions can also be used. Appropriate mechanisms are available in the current mechanical art.

The main hydrofoil assembly, especially if it is of a freely ventilating supercavitating type, can have a shortened main support, so that during normal rolled operation the main hydrofoil itself is partially clear of the water.

The attack angle adjustment mechanism can be of any design that achieves its stated function; it can be located as shown, or elsewhere in the canard assembly; it can be activated automatically, or by the sailor.

The foils and supports can be made of any strong, waterproof materials, including metals, plastics, wood, and composites. They can be of any color.

Therefore, the appended claims should be construed to cover all such changes and modifications and their equivalents as fall within the true spirit and scope of the invention.

We claim:

1. A sail-powered watercraft, comprising:

(a) a sailboard hull, a sail assembly, and sail attachment means for joining said sail assembly to said sailboard hull, (b) a main hydrofoil assembly comprising a main hydrofoil and main support means for mounting said main hydrofoil to said sailboard hull at a location rearward from the location of said sail attachment means, and (c) a canard hydrofoil assembly comprising a canard hydrofoil and canard support means for mounting said canard hydrofoil to said sailboard hull at a location forward from the location of said sail attachment means, (d) said canard hydrofoil also comprising means for inducing and maintaining a gaseous cavity on the upper surface of said canard hydrofoil during operation, (e) said canard hydrofoil assembly also comprising canard hydrofoil ventilation means for providing atmospheric air to said canard hydrofoil during operation, (f) said canard hydrofoil assembly also comprising hinge means for flexibly connecting said canard hydrofoil to said sailboard hull in such a manner that said canard hydrofoil may rotate about an axis substantially parallel to the longitudinal axis of said watercraft, whereby sail balance may be controlled.

2. The sail-powered watercraft of claim 1 wherein said hinge means comprises locking means for holding said canard hydrofoil in any of a plurality of rotational positions.

3. The sail-powered watercraft of claim 1 wherein said hinge means comprises multistable means for coercing in a predetermined manner said canard hydrofoil into any of a plurality of rotational positions.

4. The sail-powered watercraft of claim 1 wherein said hinge means comprises shifting means for moving said canard hydrofoil among a plurality of rotational positions.

5. The sail-powered watercraft of claim 1 wherein said canard support means comprises hinge means for flexibly attaching said canard hydrofoil to said canard support means in such a manner that the attack angle of said canard hydrofoil may be adjusted.

6. In an improved sail-powered watercraft, comprising:

(a) a sailboard hull, a sail assembly, and sail attachment means for joining said sail assembly to said sailboard hull, (b) a main hydrofoil assembly comprising a main hydrofoil and main support means for mounting said main hydrofoil to said sailboard hull at a location rearward from the location of said sail attachment means, (c) a canard hydrofoil assembly comprising a canard hydrofoil and canard support means for mounting said canard hydrofoil to said sailboard hull at a location forward from the location of said sail attachment means, (d) said watercraft normally operated with said sailboard hull clear of the water, rolled a substantial predetermined degree to windward, and with substantially zero yaw, the improvement comprising, (e) said canard hydrofoil assembly also comprising freely-ventilating supercavitating means for inducing and maintaining an air-filled cavity on the upper surface of said canard hydrofoil during operation, whereby plunging may be avoided, (f) said watercraft also comprising sail-force balancing means for causing the total hydrodynamic force generated by said canard hydrofoil assembly to point substantially upward while the total hydrodynamic force generated by said main hydrofoil assembly points substantially to windward and upward, whereby conventional sailboard sail and harness arrangements may be used.

7. The sail-powered watercraft of claim 6 wherein said sail-force balancing means comprises canard structure means for maintaining a predetermined portion of said canard hydrofoil oriented substantially horizontally and substantially at the water's surface and maintaining any remaining portion of said canard hydrofoil substantially clear of the water when said watercraft is rolled said predetermined degree to windward.

8. The sail-powered watercraft of claim 7 wherein said canard hydrofoil comprises a predetermined degree of dihedral.

9. The sail-powered watercraft of claim 7 wherein said canard hydrofoil comprises a plurality of laterally separated pieces.

10. The sail-powered watercraft of claim 7 wherein said canard hydrofoil comprises an arc-shaped frontal projection.

11. In an improved method of sailing comprising:

(a) providing a watercraft comprising a sailboard hull, a sail assembly, and sail attachment means for joining said sail assembly to said sailboard hull, (b) providing a main hydrofoil assembly comprising a main hydrofoil, and attaching said main hydrofoil assembly to said sailboard hull at a location rearward from the location of said sail attachment means, (c) providing a canard hydrofoil assembly comprising a canard hydrofoil, and attaching said canard hydrofoil assembly to said sailboard hull at a location forward from the location of said sail attachment means, (d) operating said watercraft suspended by said canard hydrofoil and said main hydrofoil, and with said sailboard hull clear of the water, (e) operating said watercraft rolled a substantial predetermined amount to windward, (f) operating said watercraft with substantially zero yaw, the improvement comprising, (g) operating said canard hydrofoil so that an air-filled cavity is maintained on the upper surface of said canard hydrofoil, whereby pitch stability, is improved, (h) operating said watercraft so that the hydrodynamic force generated by said canard hydrofoil points substantially upward while the hydrodynamic force generated by said main hydrofoil points substantially to windward and upward, thereby causing a separation between the centers of lateral and vertical hydrodynamic force generated by said canard hydrofoil and said main hydrofoil combined, whereby force balance is improved so that conventional sailboard sail and harness arrangements may be used.

12. The method of sailing of claim 11 wherein said watercraft is operated so that a predetermined portion of said canard hydrofoil is oriented substantially horizontally and substantially at the water's surface and any remaining portion of said canard hydrofoil is substantially clear of the water.

13. The method of sailing of claim 12 wherein said canard hydrofoil is flexibly connected to said sailboard hull in such a manner that said canard hydrofoil may rotate about an axis substantially parallel to the longitudinal axis of said sailboard hull, whereby the hydrodynamic force generated by said canard hydrofoil is made to diverge from the hydrodynamic force generated by said main hydrofoil.

14. The method of sailing of claim 13 wherein said canard hydrofoil is locked in a rotational position.

15. The method of sailing of claim 12 wherein said canard hydrofoil comprises a predetermined degree of dihedral.

16. The method of sailing of claim 15 wherein said canard hydrofoil comprises a plurality of laterally separated pieces.

17. The method of sailing of claim 12 wherein said canard hydrofoil comprises an arc-shaped frontal projection.

* * * * *